US008029206B2

(12) United States Patent
McCarthy

(10) Patent No.: US 8,029,206 B2
(45) Date of Patent: Oct. 4, 2011

(54) POLE DEVICE

(76) Inventor: Charles McCarthy, San Antonio, TX (US)

( * ) Notice: Subject to any disclaimer, the term of this patent is extended or adjusted under 35 U.S.C. 154(b) by 1027 days.

(21) Appl. No.: 11/973,661

(22) Filed: Oct. 11, 2007

(65) Prior Publication Data

US 2009/0097901 A1 Apr. 16, 2009

(51) Int. Cl.
*A46B 5/02* (2006.01)

(52) U.S. Cl. ..... 401/190; 222/174

(58) Field of Classification Search ..... 401/137–140, 401/190, 268, 278, 279; 222/174, 402.1, 222/402

See application file for complete search history.

(56) References Cited

U.S. PATENT DOCUMENTS 3,229,858 A * 1/1966 Lesh ..... 222/174
4,089,440 A 5/1978 Lee
4,886,191 A * 12/1989 Yoshitomi ..... 222/174
5,307,959 A 5/1994 Bedore et al.
5,540,359 A 7/1996 Gobbel
6,029,862 A 2/2000 Jones
6,450,423 B1 9/2002 Gurule
6,966,461 B2 11/2005 Warner et al.

* cited by examiner

*Primary Examiner* — Huyen Le
(74) *Attorney, Agent, or Firm* — David M. Driscoll, Esq.

(57) ABSTRACT

A pole apparatus for supporting and operating the push button of a spray can. The apparatus includes an elongated pole having a base end and a top end, a body member mounted at the top end of the pole, means for supporting the spray can from the body member, an actuation slide supported by the body member and including an actuation tab for engagement with the push button of the spray can, a biasing member for biasing the actuation slide to an un-actuated position and a cord that extends between the base and top ends of the pole for operating the slide member. The cord is operable by manually engaging the cord and moving the cord orthogonal to the longitudinal axis of the pole to move the slide member so that the actuation tab operates the spray can push button.

19 Claims, 14 Drawing Sheets

POLE DEVICE

TECHNICAL FIELD

The present invention relates to a pole device that is particularly adapted for mounting a spray can or the like for actuation from the ground. The pole device of the present invention includes among its uses the pruning of trees and the associated cleaning and repair of damaged tree branches or other tree parts.

BACKGROUND OF THE INVENTION

In pruning a tree the branches of the tree are typically cut and this leaves an exposed wound. If the exposed branch wound is left untreated, the tree is then vulnerable to invasion by insects and infection by diseases such as Oak Wilt. In order to prevent an infestation of a disease the wound is usually sealed. One sealing technique is to use a spray tree wound sealant. The sealant is typically provided in a 12 ounce push-button spray can.

In order to properly apply the sealant one has to be relatively close to the area of the wound. For tall trees this involves either the use of a ladder or a bucket truck. The use of a ladder can be dangerous and the bucket truck expensive. While pole devices with saws and the like are relatively readily available for carrying out the pruning step, there is presently no effective pole device available that can be operated from the ground to apply a proper sealant or dressing to the wound area of the tree. Moreover there is presently no pole device available that can combine both a cleaning step and a sealing step in a single and yet relatively simple pole structure. Furthermore existing device for remote sealant application are ineffective in use.

Accordingly, it is an object of the present invention to provide an improved device for applying a sealant to a tree part wound.

Another object of the present invention is to provide such a device that combines both a cleaning action and a sealing action in a single and yet relatively simple pole structure.

Still another object of the present invention is to provide such a device that is effective in its use, that is durable and that is safe to operate as it is constructed of electrically non-conducting material.

A further object of the present invention is to provide a pole device that can be used for any number of different applications in remotely controlling a spray can or the like.

SUMMARY OF THE INVENTION

To accomplish the foregoing and other objects, features and advantages of the present invention there is provided a device for mounting an aerosol spray can having a push-button. The device comprises a pole having a base end and a top end; a body member mounted at the top end of the pole; means for supporting the spray can from the body member; a cleaning member supported at the top end and including abrasion means for performing a cleaning action; an actuation slide supported at the body member and including an actuation tab for engagement with the push button of the spray can; a biasing member for biasing the actuation slide to an un-actuated position; and a cord that extends between the base end and top end of the pole for operating the slide member.

In accordance with other aspects of the present invention the cleaning member may comprise a metal wire brush that is directed in an opposite direction to the spray can; the body member may comprise a channel member having a lower leg for support of the bottom of the spray can; the body member may also include a channel mounting block for receiving and guiding the slide member; the means for supporting the spray can may include strap means; a collar member may be supported from the pole below the body member and for accepting the cord; and a holder may be provided at the base end of the pole for retaining the lower end of the cord, said cord being operable by manually engaging the cord and moving the cord orthogonal to the longitudinal axis of the pole to move the slide member so that the actuation tab operates the spray can push button.

In another embodiment of the present invention there is provided a pole apparatus for supporting and operating the push button of a spray can. The pole apparatus comprises an elongated pole having a base end and a top end; a body member mounted at the top end of the pole; means for supporting the spray can from the body member; an actuation slide supported at said body member and including an actuation tab for engagement with the push button of the spray can; a biasing member for biasing the actuation slide to an un-actuated position; and a cord that extends between the base and top ends of the pole for operating the slide member. The cord is operable by manually engaging the cord and moving the cord orthogonal to the longitudinal axis of the pole to move the slide member so that the actuation tab operates the spray can push button.

In accordance with still other aspects of the present invention there may be provided an integral cleaning member that is also supported at the top end of the elongated pole and including abrasion means for performing a cleaning action; the cleaning member may comprise a metal wire brush that is directed in an opposite directions to the spray can; the body member may comprise a channel member having a lower leg for support of the bottom of the spray can; the body member may also include a channel mounting block for receiving and guiding the slide member; the means for supporting the spray can may include strap means; a collar member may be supported from the pole below the body member and for accepting the cord; and a holder may be provided at the base end of the pole for retaining the lower end of the cord so that the cord is operable by manually engaging the cord and moving the cord orthogonal to the longitudinal axis of the pole.

In still another embodiment of the present invention there is provided a pole device for mounting an aerosol spray can having a push-button. The device comprises a pole having a base end and a top end; a body member mounted at the top end of the pole; the spray can being supported from the body member; an actuation slide supported by said body member and including an actuation tab for engagement with the push button of the spray can; and a cord that extends between the base and top ends of the pole for operating the slide member. The cord at its top end is connected to the actuation slide and at its bottom end is held at a fixed position. The cord is operable by manually engaging the cord at a location over the fixed position and moving the cord orthogonal to the longitudinal axis of the pole to move the slide member so that the actuation tab operates the spray can push button.

In accordance with still further aspects of the present invention there may be provided a cleaning member supported at the top end and including abrasion means for performing a cleaning action; a biasing member for biasing the actuation slide to an un-actuated position; a channel member having a lower leg for support of the bottom of the spray can; and a channel mounting block for receiving and guiding the slide member.

DESCRIPTION OF THE DRAWINGS

Numerous other objects, advantages and features of the present invention is now realized by reference to the following detailed description of the invention which are taken in conjunction with the accompanying drawings, in which.

DETAILED DESCRIPTION

Reference is now made to the drawings for an illustration of a preferred embodiment of the pole device or apparatus of the present invention. The device of the present invention is particularly adapted for use in a pruning operation in which tree branches are cut. The next step in the process is usually to clean the cut area followed by the application of a sealant. The pole device of the present invention is particularly adapted for the cleaning and sealing operation particularly from a ground position.

Figure 1:
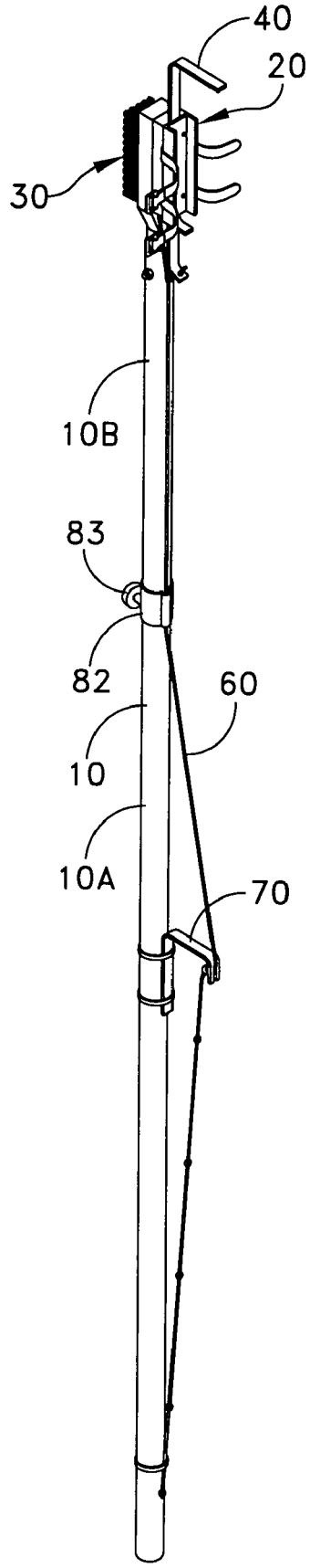
FIG. 1 is a perspective view of a preferred embodiment of the pole apparatus or pole device of the present invention.
Figure 2:
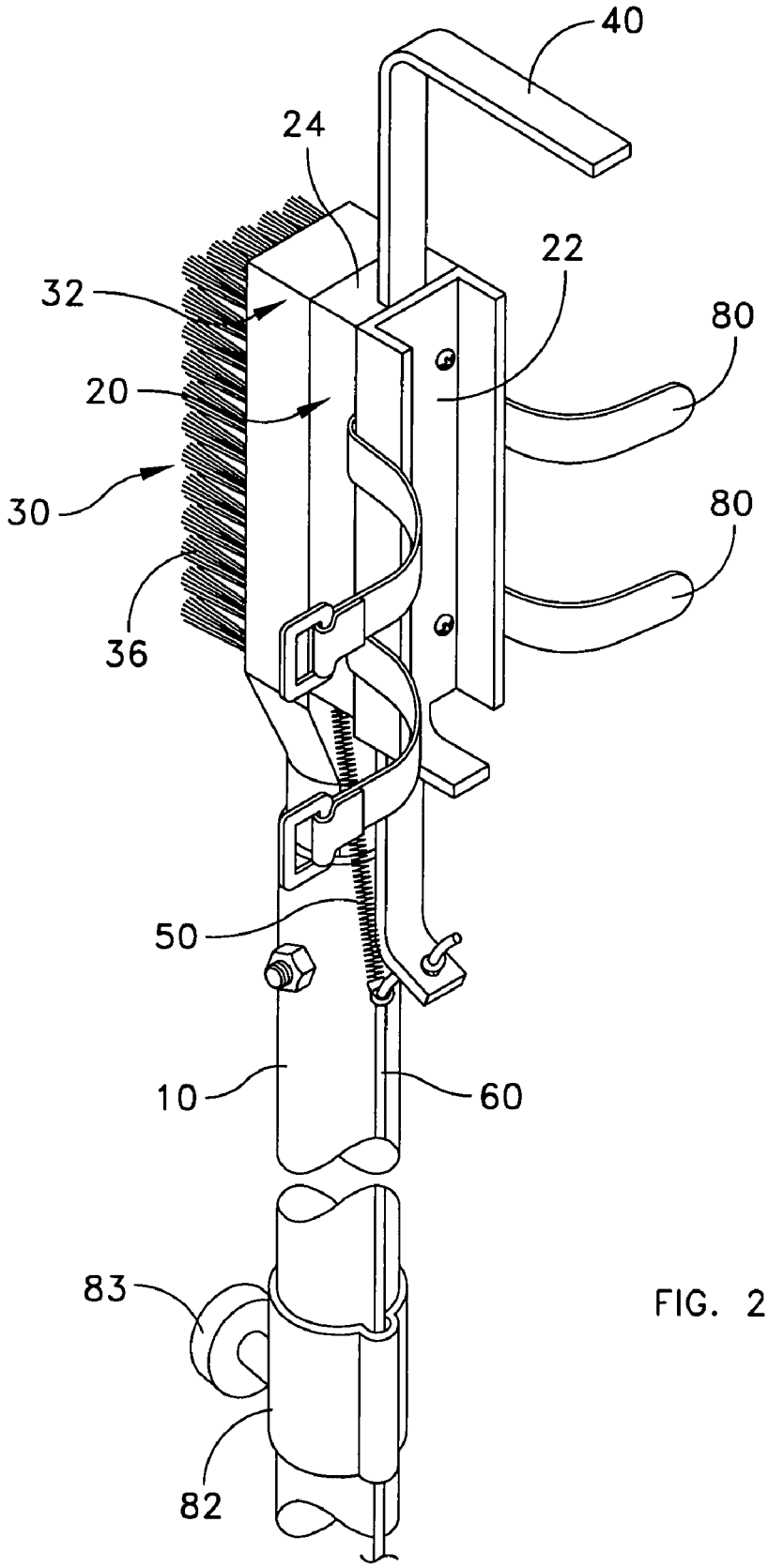
FIG. 2 is a perspective view showing the top end of the pole device including the mounting for the spray can.
Figure 14:
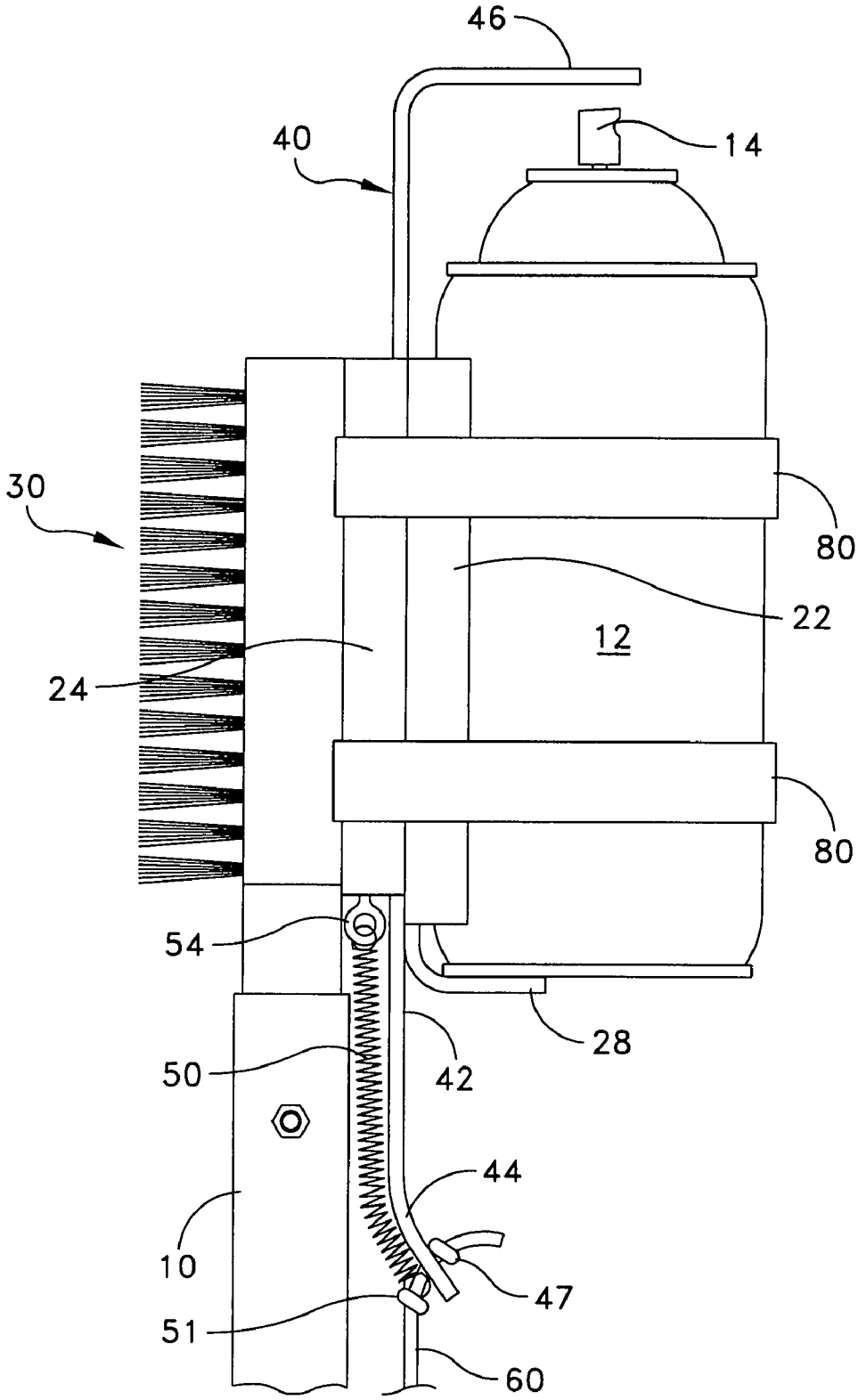
FIG. 14 is a side elevation view at the top of a pole apparatus illustrating the placement of the spray can.
Figure 18:
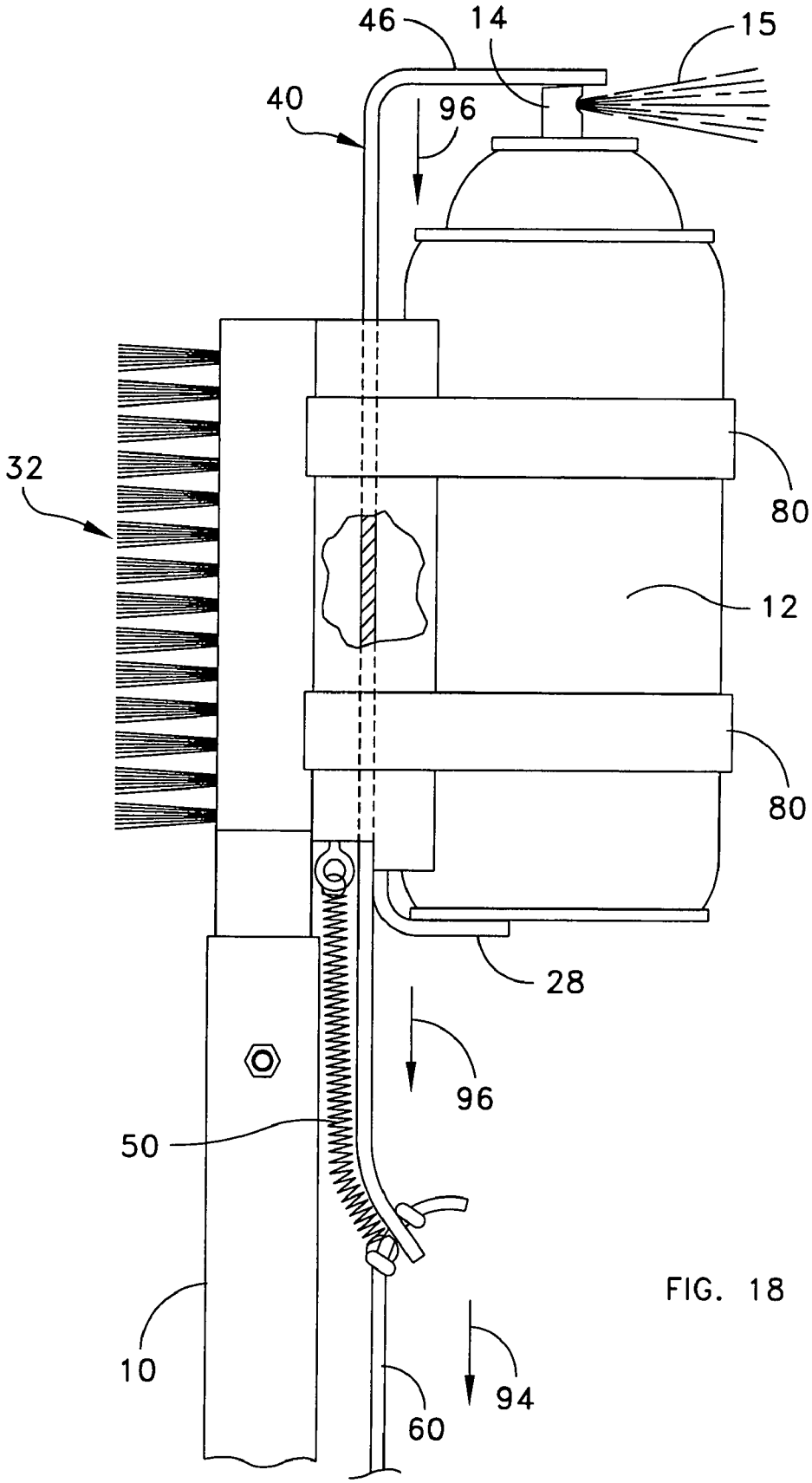
FIG. 18 is a fragmentary side view illustrating the operation of the slide member for actuation of the push button of the spray can.

Thus, as illustrated in, for example, FIGS. 1 and 2 the device includes an elongated pole 10. The pole 10 may be provided in a variety of different lengths and typically has a length on the order of 6-12 feet. The pole 10 is preferably telescopic including multiple extendable sections. FIG. 1 illustrates two sections 10A and 10B. The top end of the pole supports the spray can 12 from the body member 20. A cleaning member 30 is disposed in opposed position to the spray can 12 such as illustrated in FIG. 14. An actuation slide 40 is controlled from the cord 60 having a top end for engagement with the nozzle 14 of the spray can 12. FIG. 14 illustrates the slide member or actuation slide 40 in its release position away from the nozzle 14. On the other hand, FIG. 18 illustrates the slide member 40 engaging the nozzle 14 for the purpose of spraying the sealant from the can 12. The control of the slide member 40 is from the cord 60. A biasing member in the form of a coil spring 50 is positioned so as to normally bias the actuation slide 40 to an upper position, or in other words the position illustrated in FIG. 14. The pole 10 also accommodates an adjustment slide collar 82 that has a vertical channel or passage for receiving and slideably holding the cord 60 and a knob 83 for tightening and loosening the collar 82 on the pole 10. The collar 82 is preferably fixed on the pole section 10A, but alternatively could be attached to the pole section 10B. The rotation of the knob 83 permits the telescoping action and also the tightening of the pole sections once in place.

Figure 4:
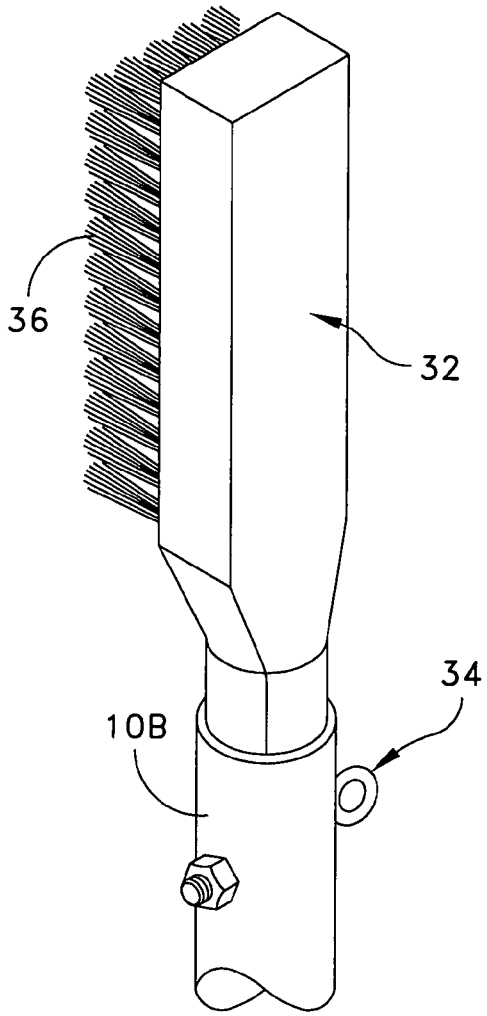
FIGS. 4 and 5 illustrate the cleaning member that is attached at the top of the pole device and is in the form of a wire brush.
Figure 5:
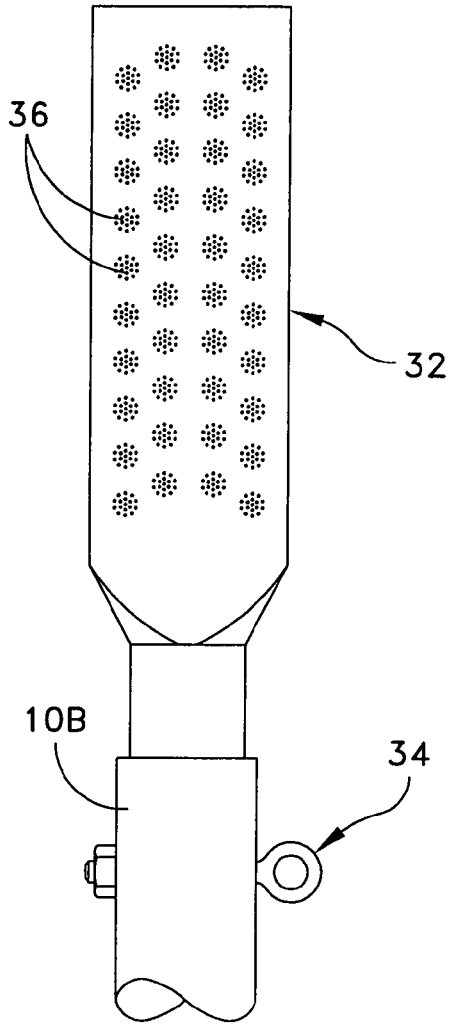

As illustrated in, for example, FIG. 2, the body member 20 is basically comprised of the U-channel member 22 and the mounting block 24. The cleaning member 30 is basically comprised of a wire brush 32. Refer also to FIGS. 4 and 5 for an illustration of the wire brush 32 which has its shaft received in the top end section 10B of the pole 10. The wire brush 32 may be secured in the top section 10B of a pole 10 in a number of different ways including the use of a fastener 34 as illustrated in FIG. 4. The wire brush 32 is provided with stiff wire bristles 36. The bristles 36 extend in the opposite direction to the spray can and useable by the operator to clean the wound area by rubbing across the wound surface.

Figure 8:
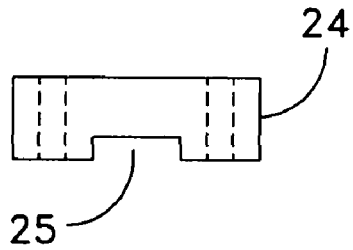
FIGS. 6-8 are views illustrating the details of the mounting block.
Figure 6:
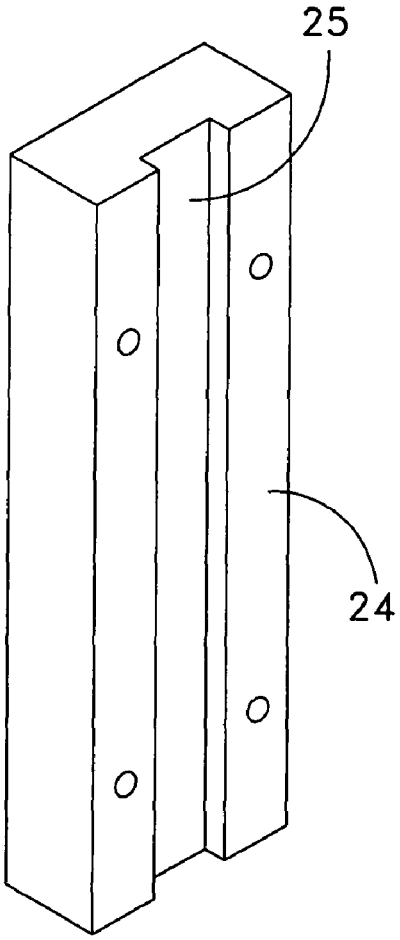
Figure 7:
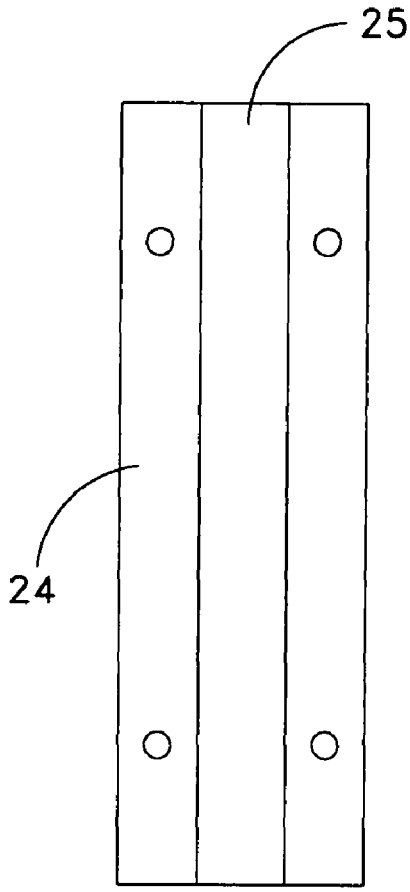
Figure 10:
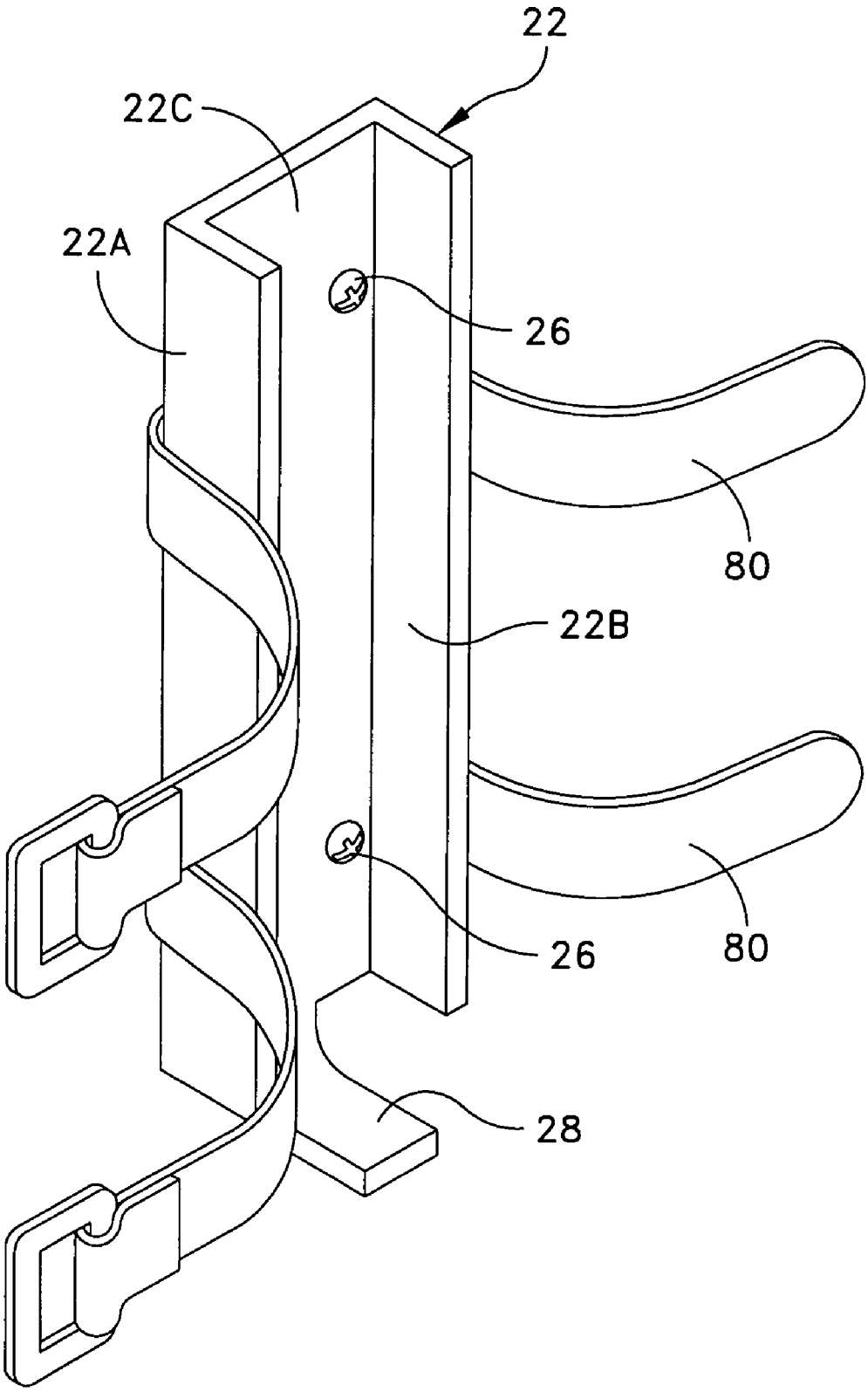
FIG. 10 is a perspective view illustrating the channel member and associated attachment straps.

Refer to FIGS. 6-8 for the details of the mounting block 24. The mounting block 24 is rectangular shape and includes a channel 25 that is dimensioned so as to receive the actuation slide 40. The mounting block 24 is also provided with a series of holes for receiving fasteners for attaching the mounting block with the wire brush 32. FIG. 10 shows fasteners 26 that may be used to fasten through the holes in the mounting block. The fasteners 26 also extend through holes in the channel member 22. FIG. 2 also illustrates the straps 80 that may be sandwiched between the channel member 22 and the mounting block 24. Each of the straps 80 has an end fastener. The straps 80 may also include Velcro strips. The straps 80 are used to secure the spray can in place as illustrated, for example, in FIGS. 13 and 14.

Figure 9:
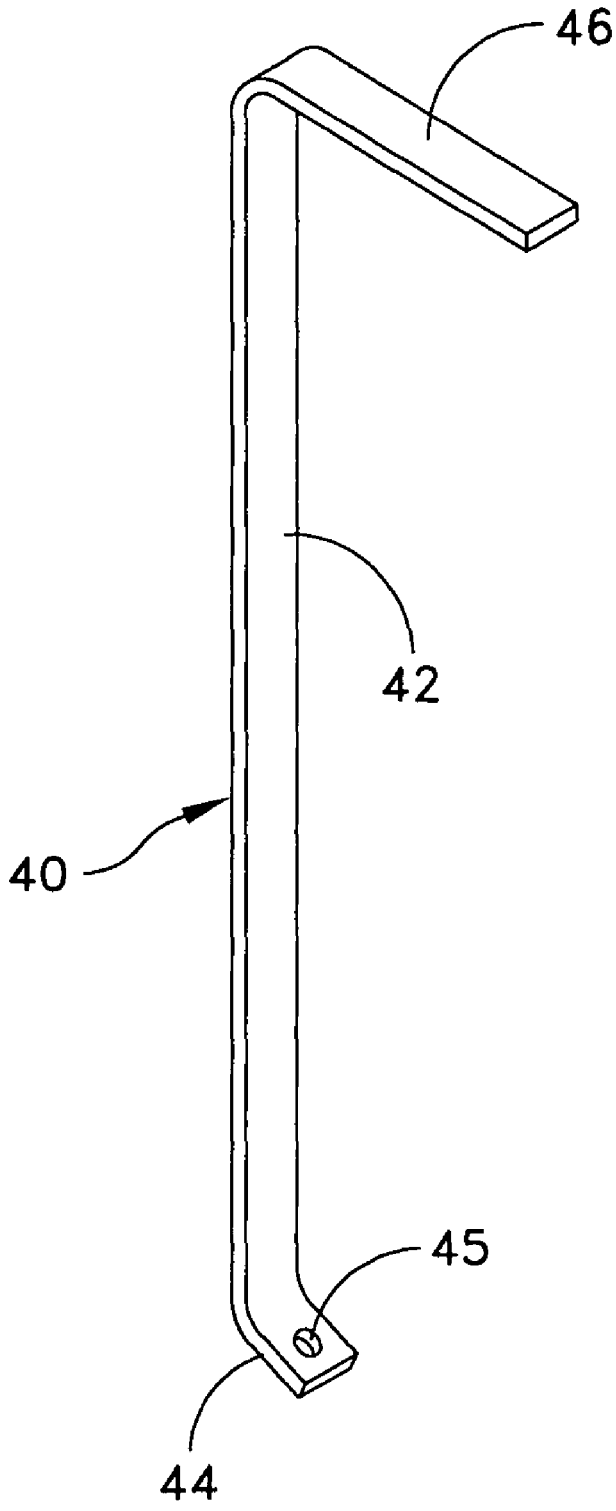
FIG. 9 is a perspective view of the actuation slide.
Figure 13:
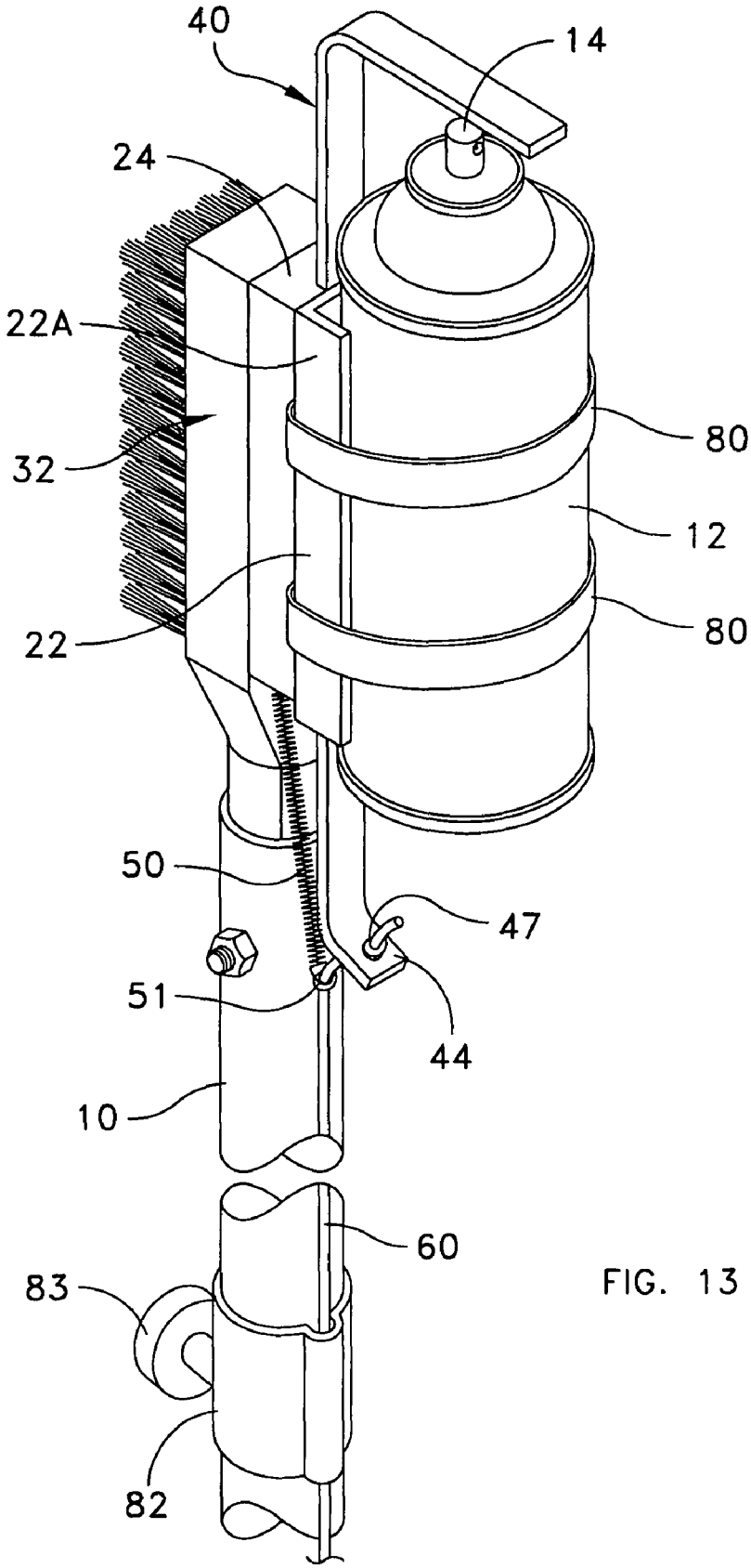
FIG. 13 is a fragmentary perspective view of the pole apparatus of the present invention illustrating the spray can in place.

Refer to FIG. 9 for a perspective view of the slide member 40. The slide member 40 includes a main stem 42. It is the main stem 42 of the slider 40 that is adapted to fit within the channel 25 of the mounting block 24. At the bottom end of the slide member 40 there is provided a tab 44 having a hole indicated at 45. At the top end of the slide member 40 there is provided a tab 46 that is used for actuation of the spray can button or nozzle. Refer to FIG. 14 showing the actuation tab 46 spaced above the spray can nozzle 14 in an un-actuated position of the slide member. Refer to FIG. 18 for an illustration of the actuator position of the slide member with the tab 46 contacting the spray button 14 so as to eject a spray as illustrated at 15 in FIG. 18. Refer also to FIG. 13 which shows the bottom tab 44 of the slide member 40 and the cord 60 attached thereto at 47. This attachment may be by means of a single or double knot so that the cord 60 is firmly attached to the slide member for actuation thereof. It is also noted in FIG. 13 that the cord 60 passes through a lower end 51 of the biasing spring 50.

Figure 11:
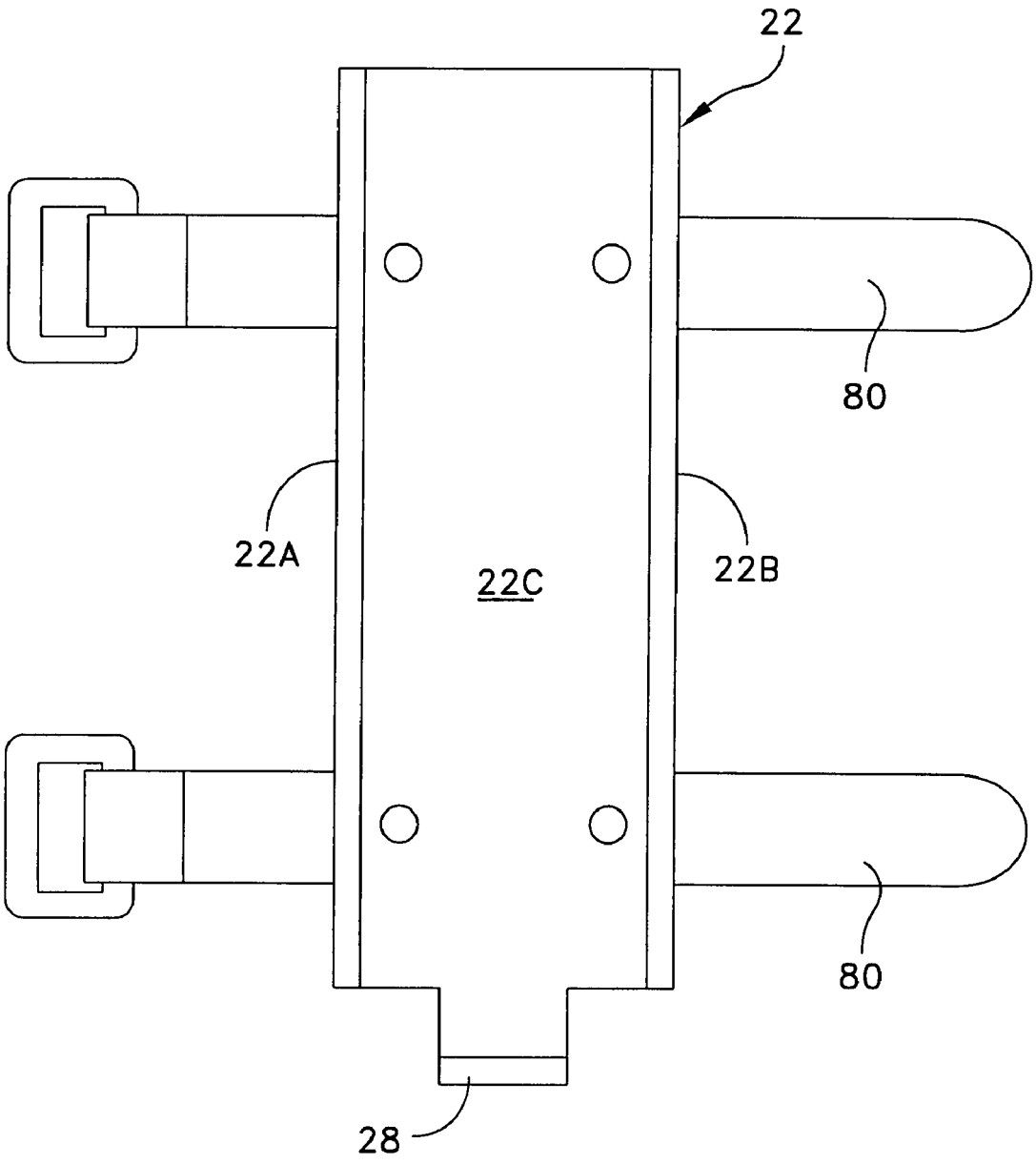
FIG. 11 is a further front view of the channel member and also illustrating the associated attachment straps.

Reference is now made to FIGS. 10 and 11 for further details of the channel member 22. FIGS. 10 and 11 also illustrate the straps 80. The channel member 22 is of U-shape having side walls 22A and 22B and a base wall 22C. As illustrated in FIG. 10, the fasteners 26 extend through holes in the base wall 22C, then through holes in the mounting block, and into the wire brush structure. The wire brush structure is typically wood while the channel member is typically metal and the mounting block is preferably constructed of a hard plastic material, but could also be made of wood or other suitable hard materials.

FIGS. 10 and 11 also illustrate that, at the bottom of the channel member 22, there is provided a base leg 28. This leg functions as a rest point for the spray can 12 such as is illustrated in FIG. 14 where the base of the can is shown resting upon the leg 28. As also illustrated in FIGS. 10 and 13, the side walls 22A and 22B form a channel for receiving and holding the spray can 12. That channel, along with the straps 80 firmly secures the spray can in place. As indicated previously, the base leg 28 holds the bottom of the spray can 12. The spray can 12 is thus in a position for actuation by the slide member 40.

Figure 3:
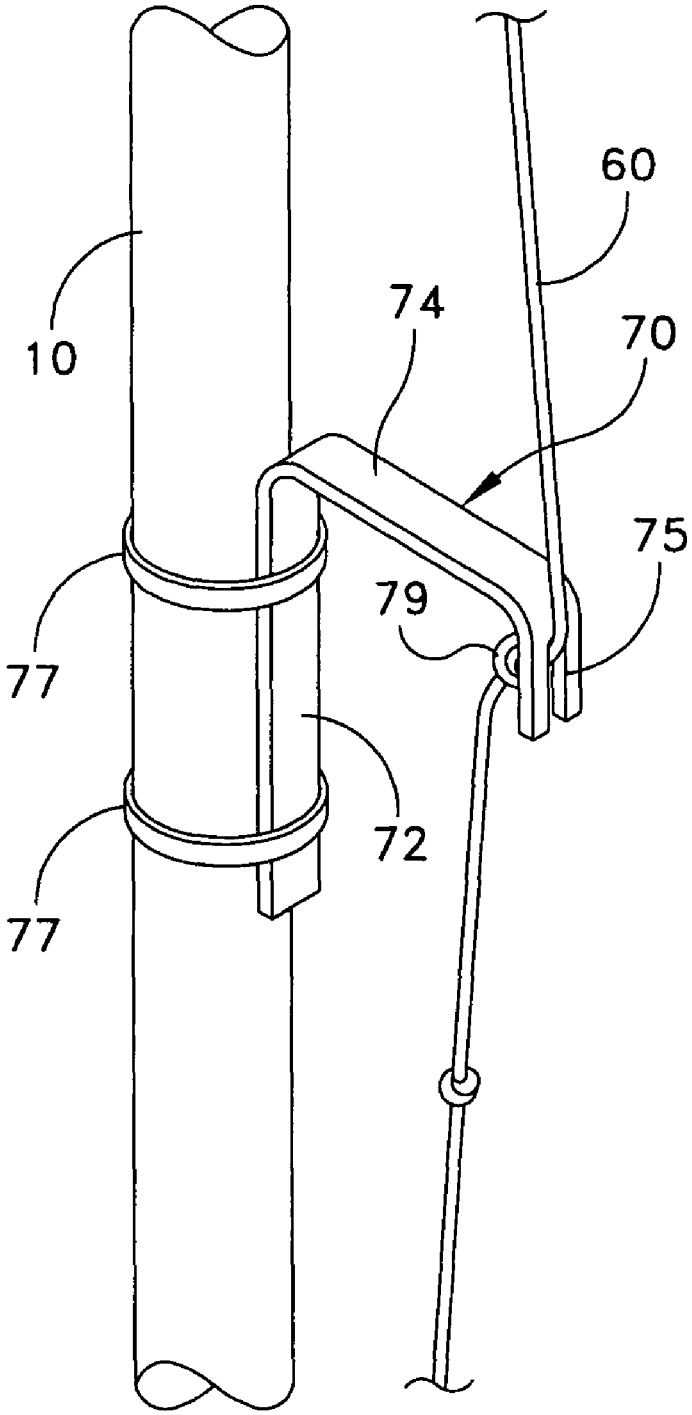
FIG. 3 is a fragmentary perspective view at a lower position of the pole device illustrating the cord attached at a fixed location.
Figure 12:
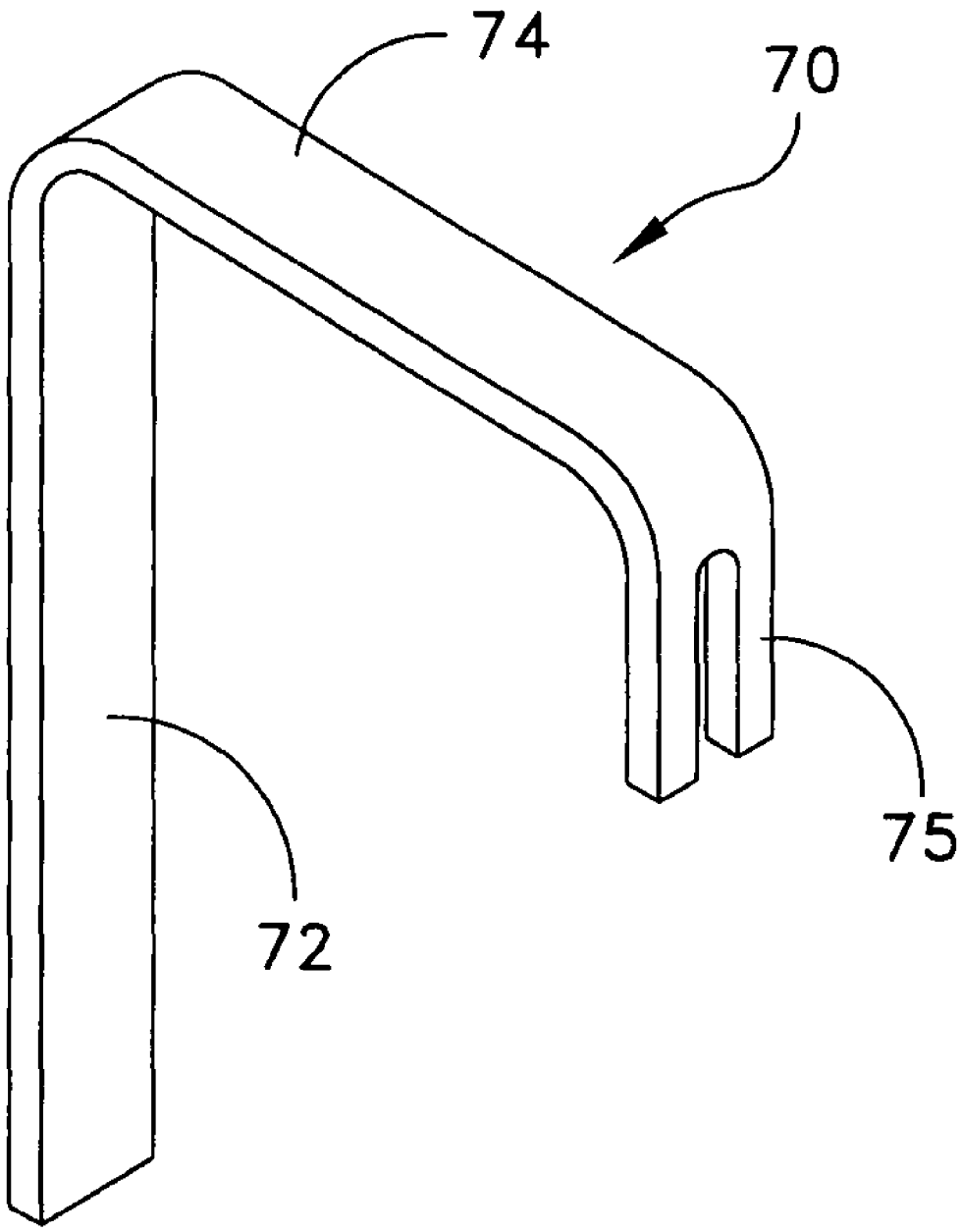
FIG. 12 is a perspective view of the L-shaped retainer.
Figure 17:
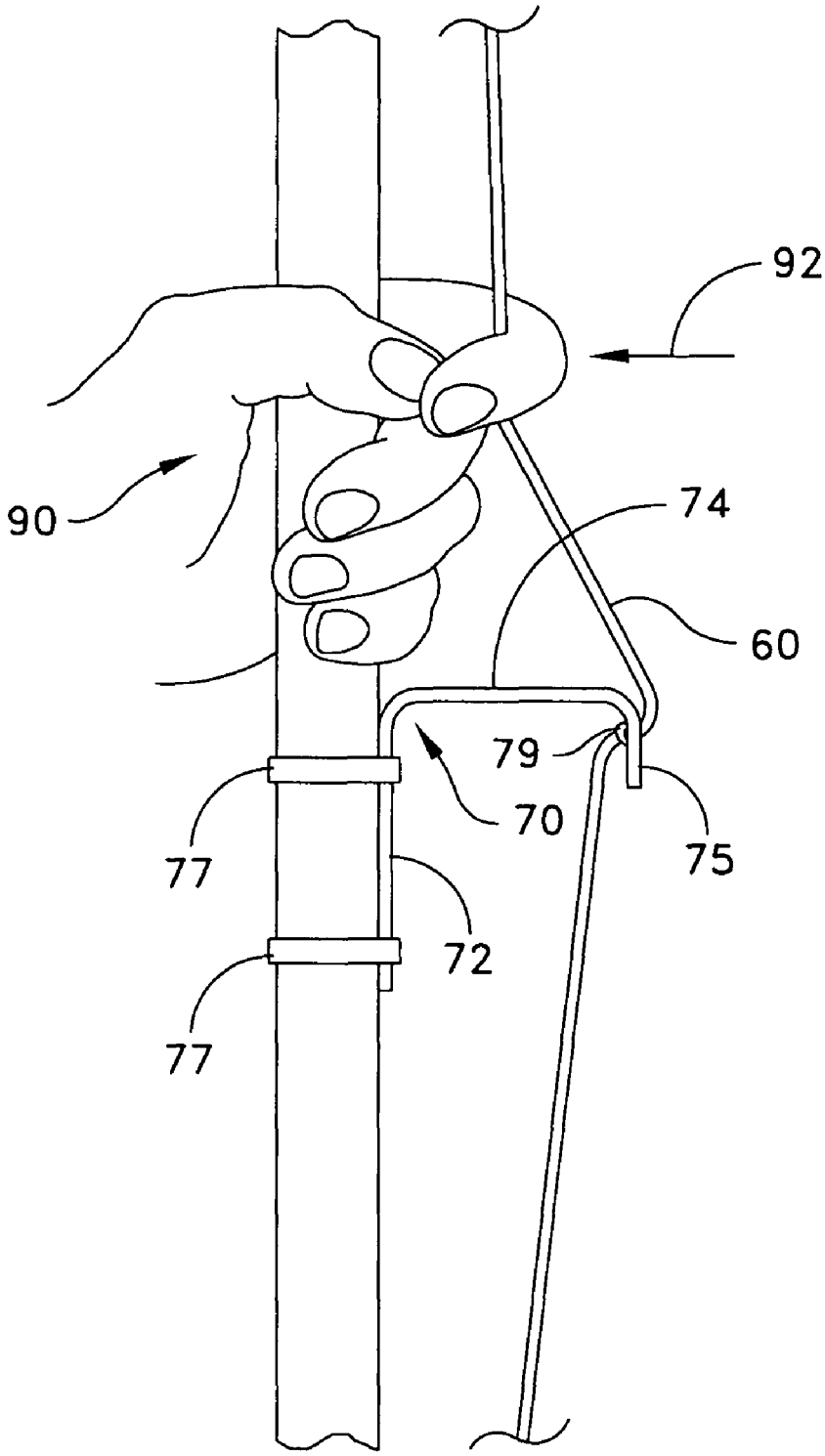
FIG. 17 is a fragmentary side view illustrating the side view illustrating the manner in which the cord is actuated.

Reference is now made to FIG. 12 which shows an L-shaped retainer 70. The retainer 70 includes legs 72 and 74, as well as a slotted end 75. As illustrated, for example, in FIGS. 1 and 3 the leg 72 of the retainer 70 is secured by means of bands or rings 77 to the pole 10. The bands 77 may be any number of variety of different types of fasteners that can be tightened to secure the retainer 70 in the desired position. The bands are preferably constructed to fix the position of the retainer 70, but the bands could also be adjustable. As illustrated in FIG. 3, the slotted end 75 of the retainer 70 holds the cord 60 preferably with the use of a knot 79. Refer also to the side elevational view of FIG. 17 showing the position of the retainer 70 with respect to the cord 60. FIG. 17 also illustrates the knot at 79 that is used to hold the cord 60 in position.

As indicated previously, the spring 50 is normally used to bias the slide member 40 to an upper position as illustrated in FIG. 14. FIG. 14 also illustrates the spring 50 attached at its bottom end 51 to the cord 60 and attached at its top end to the eyelet 54 which is in turn secured into the mounting block 24. Thus, the top end of the spring 50 is maintained at a fixed position while the bottom end of the spring moves with the movement of the cord 60. The attachment at the ends of the spring, as shown in FIG. 14, is by means of respective closed end loops.

Figure 15:
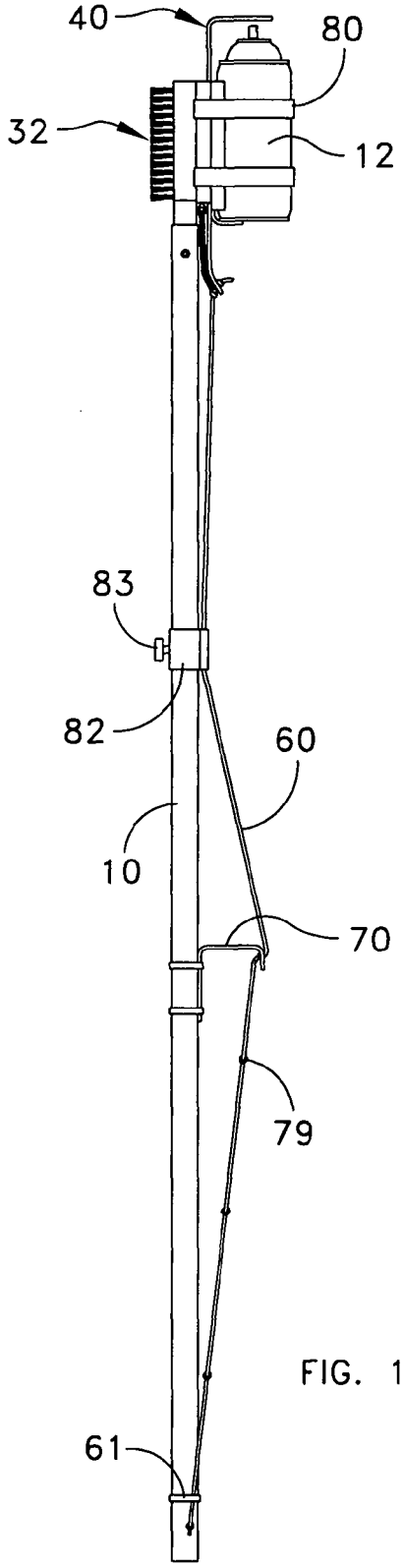
FIG. 15 is a side view of the pole apparatus illustrating the manner in which the cord is attached.

FIG. 15 illustrates the pole apparatus in its normal, unactuated state. It is noted that the cord 60 is held in a relatively taut position at the retainer 70. The cord 60 is in a taut position between the retainer 70 and the collar 82. Below the retainer 70, the cord may also be maintained in a relatively straight position as illustrated in FIG. 15. The bottom end of the cord 60 may be secured in some manner as at 61. Pole section 10B is extended relative to pole section 10A so as to make the cord 60 taut and can then be locked in the desired position by means of the knob 83. As shown in FIG. 15, the lower end of the cord is provided with several spaced knots 79. Depending on the extended length of the preferred telescopic pole, one of the knots can be engaged at the retainer 70. The pole section 10B is extended so as to tighten the cord, particularly between the retainer 70 and collar 82.

The following are direction for adjusting the tension on the cord 60. First, one determines the approximate desired length of the pole by loosening the knob 83 of the collar 82. Next, the appropriate knot 79 on the cord 60 is selected, and the cord is then inserted into the slotted end 75 of the L-shaped retainer 70. The pole section 10B is then extended until there is a slight tension on the cord 60. At that point the actuation tab 46 is about one-half inch from the spray nozzle 14. The knob 83 can then be tightened and the pole apparatus is ready for use.

Figure 16:
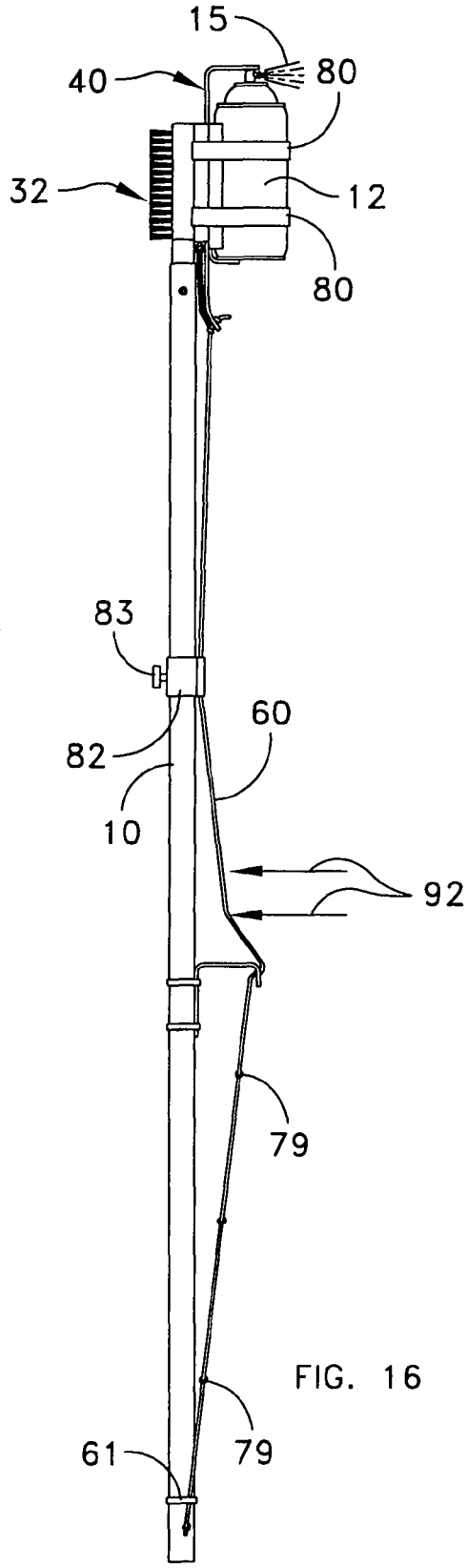
FIG. 16 is a view similar to that illustrated in FIG. 15 and showing the actuation of the spray can by movement of the actuation cord.

Reference is now made to FIGS. 16 and 17 to show the preferred mode of operation of the pole device of the present invention. FIG. 17 shows the hand 90 grasping the pole with one of the fingers wrapped about the cord 60. This action pulls the cord 60 in the direction of arrow 92, so as to, in turn, move the cord 60 in the direction of arrow 94 in FIG. 18. This action likewise moves the slide member downwardly in the direction of arrows 96 in FIG. 18. This action in turn moves the actuation tab 46 downwardly as illustrated in FIG. 18 depressing the button or nozzle 14 so as to cause a spraying action. This action goes against the spring force of spring 50. Thus, when the cord is released the spring force returns the slide member to its upper position, such as the one illustrated in FIG. 14.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A device for mounting an aerosol spray can having a push-button, said device comprising:

a pole having a base end and a top end;

a body member mounted at the top end of the pole;

means for supporting the spray can from the body member;

a cleaning member supported at the top end and including abrasion means for performing a cleaning action;

an actuation slide supported at said body member and including an actuation tab for engagement with the push button of the spray can;

a biasing member for biasing the actuation slide to an un-actuated position;

a cord that extends between the base and top ends of the pole for operating the slide member and;

a holder at the base end of the pole for retaining the lower end of the cord, said cord being operable by manually engaging the cord and moving the cord orthogonal to the longitudinal axis of the pole to move the slide member so that the actuation tab operates the spray can push button.

2. The device of claim 1 wherein said cleaning member comprises a metal wire brush that is directed in an opposite directions to said spray can.

3. The device of claim 1 wherein said body member comprises a channel member having a lower leg for support of the bottom of the spray can.

4. The device of claim 3 wherein the body member also includes a channel mounting block for receiving and guiding the slide member.

5. The device of claim 1 wherein said means for supporting the spray can includes strap means.

6. The device of claim 1 including a collar member supported from said pole below said body member and for accepting said cord.

7. A pole apparatus for supporting and operating the push button of a spray can, said pole apparatus comprising:

an elongated pole having a base end and a top end;

a body member mounted at the top end of the pole;

means for supporting the spray can from the body member;

an actuation slide supported at said body member and including an actuation tab for engagement with the push button of the spray can;

a biasing member for biasing the actuation slide to an un-actuated position; and a cord that extends between the base end and top end of the pole for operating the slide member;

said cord being operable by manually engaging the cord and moving the cord orthogonal to the longitudinal axis of the pole to move the slide member so that the actuation tab operates the spray can push button.

8. The pole apparatus of claim 7 further including an integral cleaning member that is also supported at the top end of the elongated pole and including abrasion means for performing a cleaning action.

9. The apparatus of claim 8 wherein said cleaning member comprises a metal wire brush that is directed in an opposite direction to said spray can.

10. The apparatus of claim 7 wherein said body member comprises a channel member having a lower leg for support of the bottom of the spray can.

11. The apparatus of claim 10 wherein the body member also includes a channel mounting block for receiving and guiding the slide member.

12. The apparatus of claim 7 wherein said means for supporting the spray can includes strap means.

13. The apparatus of claim 7 including a collar member supported from said pole below said body member and for accepting said cord.

14. The apparatus of claim 7 including a holder at the base end of the pole for retaining the lower end of the cord so that the cord is operable by manually engaging the cord and moving the cord orthogonal to the longitudinal axis of the pole.

15. A device for mounting an aerosol spray can having a push-button, said device comprising:

a pole having a base end and a top end;

a body member mounted at the top end of the pole;

the spray can being supported from the body member;

an actuation slide supported by said body member and including an actuation tab for engagement with the push button of the spray can;

a cord that extends between the base and top ends of the pole for operating the slide member;

said cord at its top end connected to said actuation slide and at its bottom end held at a fixed position;

said cord being operable by manually engaging the cord at a location over the fixed position and moving the cord orthogonal to the longitudinal axis of the pole to move the slide member so that the actuation tab operates the spray can push button.

16. The device of claim 15 further including a cleaning member supported at the top end and including abrasion means for performing a cleaning action.

17. The device of claim 15 further including a biasing member for biasing the actuation slide to an un-actuated position.

18. The device of claim 14 wherein said body member comprises a channel member having a lower leg for support of the bottom of the spray can.

19. The device of claim 18 wherein the body member also includes a channel mounting block for receiving and guiding the slide member.

* * * * *